United States Patent [19]

Weill

[11] Patent Number: 4,597,997

[45] Date of Patent: Jul. 1, 1986

[54] FOAM PAINT SET

[76] Inventor: Linda Weill, 2 Raymond Ave., San Anselmo, Calif. 94960

[21] Appl. No.: 738,926

[22] Filed: May 29, 1985

[51] Int. Cl.[4] ..... B05D 1/02

[52] U.S. Cl. ..... 427/288; 427/421; 434/84

[58] Field of Search ..... 8/477; 434/103, 84; 427/288, 421

[56] References Cited

U.S. PATENT DOCUMENTS

| | | | |
|---|---|---|---|
| 3,110,423 | 11/1963 | Hegedic et al. | 222/135 |
| 3,884,627 | 5/1975 | Brody | 8/477 |
| 3,946,906 | 3/1976 | Schwede | 222/135 |
| 3,977,826 | 8/1976 | Iscowitz | 8/477 |
| 4,376,142 | 3/1983 | Allen | 427/412 |
| 4,423,161 | 12/1983 | Cobbs et al. | 427/244 |

*Primary Examiner*—Shrive P. Beck

*Attorney, Agent, or Firm*—Townsend & Townsend

[57] ABSTRACT

Water-based foam paints are provided in aerosol applicators. Water-soluble, non-toxic color additives are added to a foam-producing emulsion base to form a foam when the emulsion is sprayed from a conventional aerosol bomb. In the preferred embodiment, a system of three aerosol applicators corresponding to the three primary colors is utilized so that secondary colors can be created by mixing the appropriate portions of the primary colors.

3 Claims, No Drawings

FOAM PAINT SET

BACKGROUND OF THE INVENTION

1. Field of the Invention

The present invention relates generally to water-based paints and systems for applying such paints, and more particularly to aerosol applicators for a foam-producing composition having a water-based coloring additive.

Painting with watercolors is an activity which has been enjoyed by children, and adults, for many years. Watercolor sets used by children have typically comprised a small metal or plastic case holding a plurality of solid color pellets. The user would first wet a brush and use the wetted brush to dissolve a portion of the color pellet and take up the color onto the brush. Although workable, such water color sets suffered from a number of disadvantages. The sets were inconvenient in that each color had to be individually wetted and dissolved prior to use. Under such circumstances, it was difficult to control the intensity of the color, and frequently the color would be either too concentrated or too diluted. Moreover, the use of such watercolors was very messy, with brushes dripping onto clothing, furniture, carpeting, and many other unintended locations. Another problem resulted from carrying too much water on the brush to the paper. The paper often became saturated, resulting in an excessive drying time or even decomposition of the paper.

It would therefore be desirable to provide alternate watercolor materials and methods which would avoid the above-described problems. In particular, it would be desirable to provide a novel watercolor system which avoids the use of solid color pellets which must be dissolved with water immediately prior to use.

2. Description of the Prior Art

U.S. Pat. No. 4,050,944 to Cartwright discloses a foam concentrate which is used to mark farmland as it is being sprayed with mobile spraying equipment. Foam is generated from the concentrate by a mechanical spray nozzle, and coloring may be added to the concentrate in order to improve its visibility. U.S. Pat. No. 4,023,524 to Goldfarb et al. discloses a toy spray gun which acts as an atomizer in spraying a liquid paint onto a surface, e.g., paper. U.S. Pat. No. 3,747,232 to Donaldson et al. discloses a particular painting substrate which includes an absorbent layer laminated to a non-absorbent layer. Donaldson et al. teach that primary colors may be mixed on this particular substrate.

SUMMARY OF THE INVENTION

According to the present invention, a product and method are provided for painting watercolor pictures on absorptive, e.g., paper, surfaces. The product is an aerosol applicator containing a water-based foam-producing composition having a preselected color additive. The foam may be sprayed onto any surface which is receptive to watercolor paints, and may be spread on the surface using brushes, spatulas, brayers, fingers, or any of a variety of other tools. Preferably, the aerosol applicators are provided in sets of multiple colors, usually including at least the three primary hues, i.e., blue, yellow, and red. It has been found that the use of foam watercolor paints allows easy mixing of the paints on the surface to be painted. By working with the three primary colors, the user can thus obtain a wide variety of other colors in the final painting.

The use of foam water colors provides a number of advantages when compared with the prior art. The colors may be easily dispensed from the aerosols and do not require a separate source of water to dissolve the paint. The texture and concentration of the paint is constant and does not vary according to how the user makes it up. The foam paints are quick drying and not prone to dripping. Moreover, it has been found that the use of foam paints allows painting techniques which are simply incapable of duplication using conventional watercolor sets which have heretofore been available to the public.

DESCRIPTION OF THE PREFERRED EMBODIMENTS

The water-based foam paints of the present invention are produced by spraying a conventional water-based foam-producing emulsion from an aerosol applicator. The emulsion produces an aqueous foam which acts as a solvent in carrying a preselected color additive.

Conveniently, the foam-producing emulsion may be of the type commonly employed in shaving creams. For example, a mixture of one or more fatty acids may be reacted with a mixture of caustic potash and caustic soda. A coloring additive is introduced, and other additives such as emulsifiers, emollients, thickeners, preservatives, bactericides, and the like may be added. The foam is created by spraying the mixture from a conventional aerosol bomb, forming an aerogel which is applied to the surface to be painted.

Color additives suitable for use in the water-based foam paints of the present invention should be washable and non-toxic. Suitable color additives include the FD&C food colorings, and a representative list of such food colorings is provided in Table 1.

TABLE 1

Blue No. 1: Disodium salt of 4-((4-(N-ethyl-p-sulfobenzylamino)-phenyl)-(2-sulfoniumphenyl)-methylene)-(1-N-ethyl-N-p-sulfobenzyl)-$\Delta^{2,5}$-cyclohexadienimine).

Blue No. 2: Disodium salt of 5,5'-indigotindisulfonic acid.

Green No. 3: Disodium salt of 4-((4-(N-ethyl-p-sulfobenzylamino)-phenyl-(4-hydroxy-2-sulfoniumphenyl)-methylene)-(1-(N-ethyl-N-p-sulfobenzyl)-$\Delta^{2,5}$-cyclohexadienimine).

Red No. 3: Disodium salt of 9-o-carboxyphenyl-6-hydroxy-2,4,5,7-tetraiodo-3-isoxanthone.

Red No. 40: Disodium salt of 6-hydroxy-5-[(2-methyloxi-5-methyl-4-sulfophenyl)azo]-2-naphthalene sulfonic acid.

Yellow No. 5: Trisodium salt of 3-carboxy-5-hydroxy-1-p-sulfophenyl-4-sulfophenylazopyrazole.

Yellow No. 6: Disodium salt of 1-p-sulfophenylaze-2-naphthol-6-sulfonic acid.

Particularly preferred are Blue No. 1, Red No. 3, Red No. 40, and Yellow No. 5, corresponding to the primary colors. Use of the primary colors as the foam paints is preferred because it allows the user to create a wide variety of colors by mixing the appropriate amount of each primary color.

The preferred formulations for the colored foam-producing emulsions of the present invention are set forth in Table 2.

TABLE 2

| Component | | Weight % Range | Weight % Preferred |
|---|---|---|---|
| Mixed fatty acids | Emersol[a] 110 | 3.0–4.0% | 3.6% |
| | Emersol[a] 120 | 3.0–4.0% | 3.6% |
| | Coconut fatty acid | 1.0–2.0% | 1.5% |
| Preservative | Dowicil[d] 200 | 4.0–7.0% | 5.7% |
| | Methyl paraben | 0.1–0.5% | 0.3% |
| | Propyl paraben | 0–0.2% | 0.1% |
| Emulsifier | Poly(N—vinyl-2-pyrrolidinone) | 0–0.5% | 0.3% |
| Saponifier | Caustic potash[e] | 1.5–4.0% | 2.1% |
| | Caustic soda | 0–1.25% | 0.7% |
| Color additve | Blue No. 1 | 0.1–0.4% | 0.15% |
| | Red No. 3 | 0.02–0.25% | 0.03% |
| | Red No. 40 | 0.1–0.4% | 0.12% |
| | Yellow No. 5 | 0.1–0.4% | 0.25% |
| Others | Ninol[b] 128 | 2.0–3.0% | 2.5% |
| | cetyl alcohol | 0–1.5% | 0.8% |
| | Steol[c] | 2.0–4.0% | 3.0% |
| Water | | Remainder | |

[a]Trademark of Emery Industries, Inc., Cincinnati, Ohio.
[b]A foam-enhancer (cocoamide-DEA); Trademark of Stepan Co.
[c]Anionic detergent (sodium laureth-7-sulfate); Trademark of Stepan Co.
[d]Trademark of Dow Chemical Co., Midland, Michigan.
[e]Caustic potash and soda are added to adjust pH in the range from about 8.4 to 9.4.

The above formulations are packaged in conventional aerosol bombs including a compressed liquid or gas propellant. Suitable propellants include various low boiling hydrocarbons, such as butane, isobutane, propane, and the like; chlorofluoro hydrocarbons, such as Freon; carbon dioxide; and the like. A suitable propellant for the above formulations consists of a mixture of butane, isobutane, and propane in an approximately 2:1:2 mixture by volume.

The foam paints of the above formulations may be prepared by first blending an oil phase consisting of the fatty acids, cetyl alcohol, and surface active agents. The oil phase is heated to about 150° F. until a uniform solution is obtained. A separate aqueous phase is prepared by blending the remaining ingredients, other than the color additive(s), in the water. The aqueous phase is also heated to about 150° F., and the oil phase and aqueous phase are then blended with gentle agitation. The color additives are added to the oil and water emulsion after it cools, and the colored emulsions are then packaged in the aerosol bombs by conventional techniques. The foam is created as the foam-producing emulsion is sprayed from the aerosol bombs so that the propellant gas acts as the gas phase in the foam.

The foam paints are used by spraying from the aerosol can directly onto a paper palette, then applied to the surface to be painted. Any two colors mixed together will create a secondary color (red and yellow/orange, blue and yellow/green, red and blue/purple). Fingers, brush, brayer, sponge, vegetables, etc. may be used to spread the foam paint. Many pleasing effects can be obtained using the foams singly or in combination. The spray foams of the present invention are particularly convenient since they do not require mixing by the user, are uniformly applied at all times, and are rapid drying.

The ability to first spray the foam paint onto a surface, and then apply the foam as desired differentiates the paints of the present invention from prior art spray paints as well as prior art water color paints. The foam paints can be used to fill in designs drawn with a pencil, pen or crayon by first spraying, and then spreading the foam. Excess paint can be removed by wiping with a paper towel.

Alternatively, the foam paints of the present invention can be used for "image transfer" by spraying onto a non-porous surface, such as glass or formica and transferring the paint by placing a clean sheet of paper on top and gently rubbing.

Use of the foam paints of the present invention is not limited to paper. The foam paints may be used to paint a variety of other materials, such as cloth fabrics, clay, baker's dough, plaster, and the like.

In addition, the foam paint can be used in stencil printmaking and silkscreening.

Although the foregoing invention has been described in some detail by way of illustration and example for purposes of clarity of understanding, it will be obvious that certain changes and modifications may be practiced within the scope of the appended claims.

What is claimed is:

1. An improved method for producing a decorative coating by applying water-based paints to a surface, said method characterized by spraying at least two water-based foam compositions having preselected different color additives to the surface by means of aerosol applicators, wherein said foam compositions and said color additives are combined in an aerosol container prior to spraying, combining the foams on the surface by spreading the foams together to vary the resulting color, and allowing the paints to dry to form a permanent image.

2. An improved method as in claim 1, employing three water-based foam compositions including color additives corresponding to the primary colors.

3. An improved method as in claim 1, wherein the two foam compositions are first sprayed onto a paper palette and combined prior to application to the surface.

* * * * *